US007076922B1

(12) United States Patent
Parres

(10) Patent No.: US 7,076,922 B1
(45) Date of Patent: Jul. 18, 2006

(54) INTERCONNECTING SOUND ATTENUATING ENCLOSURE

(76) Inventor: Jacob L. Parres, 702 Sharon Dr., Camarillo, CA (US) 93010

( * ) Notice: Subject to any disclaimer, the term of this patent is extended or adjusted under 35 U.S.C. 154(b) by 320 days.

(21) Appl. No.: 10/681,665

(22) Filed: Oct. 7, 2003

(51) Int. Cl.
*E04H 1/00* (2006.01)

(52) U.S. Cl. ..... 52/79.5; 52/646

(58) Field of Classification Search ..... 135/900, 135/901, 902, 904, 909, 157, 121; 52/79.1, 52/79.5, 645, 646, DIG. 13, 70, 71
See application file for complete search history.

(56) References Cited

U.S. PATENT DOCUMENTS 3,517,468 A * 6/1970 Woods ..... 52/79.1
3,863,412 A * 2/1975 Bodycomb et al. ..... 52/481.2
3,987,597 A * 10/1976 Smrt ..... 52/764
5,036,634 A * 8/1991 Lessard et al. ..... 52/79.1
5,375,641 A * 12/1994 Schlueter ..... 160/135
5,555,681 A * 9/1996 Cawthon ..... 52/63
5,640,811 A * 6/1997 Boyle et al. ..... 52/86
6,550,216 B1 * 4/2003 Ohanesian ..... 52/783.11

* cited by examiner

*Primary Examiner*—Naoko Slack
*Assistant Examiner*—Jessica Laux
(74) *Attorney, Agent, or Firm*—Albert O. Cota

(57) ABSTRACT

An interconnecting sound attenuating enclosure (20) that incorporates a detachable structural frame (22) made of thermoplastic pipe (34) with slip-in fittings (36), thus providing joints that are dissembled for transportation and storage. A set of walls, doors and a top consisting of individual panels (48) covered with fabric bags (58) are attached to the outside of the structural frame (22) to form the enclosure (20). The sound produced within the enclosure (20) is attenuated to a sufficient degree to be acceptable by others nearby.

13 Claims, 6 Drawing Sheets

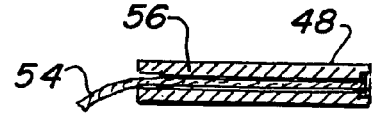
FIG. 7
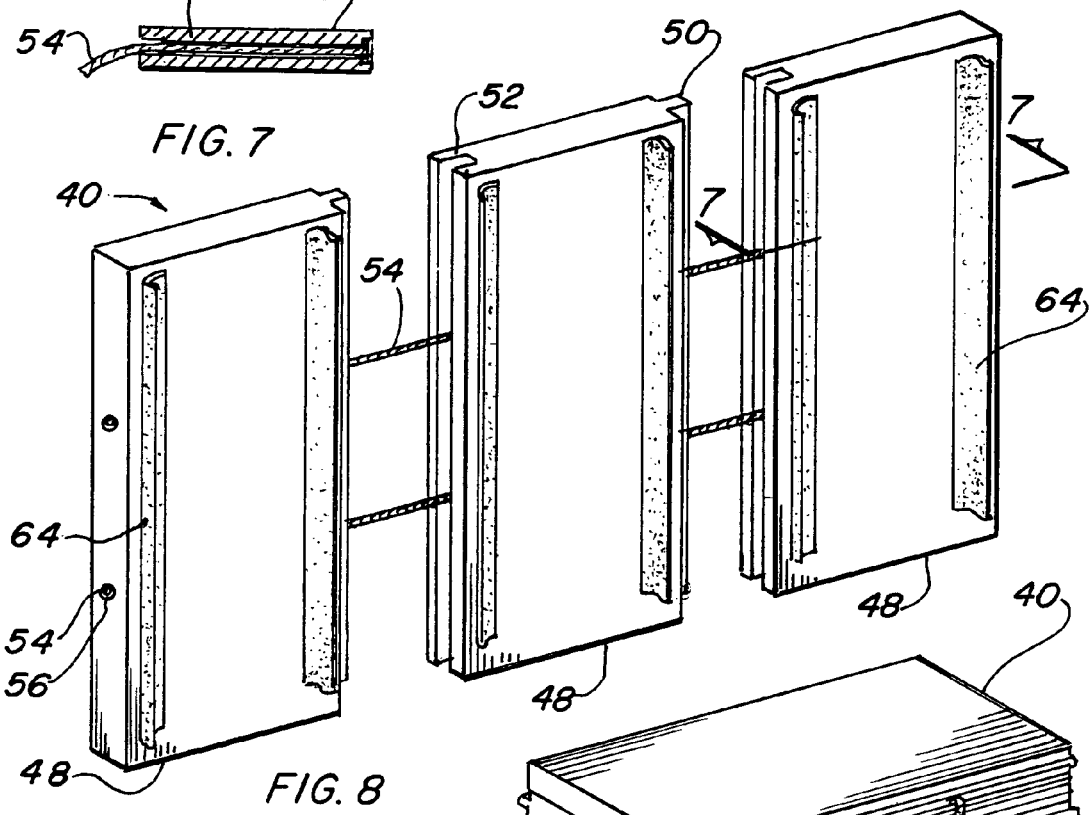
FIG. 8
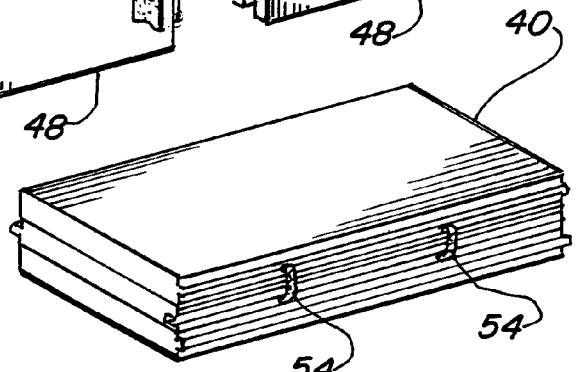
FIG. 9
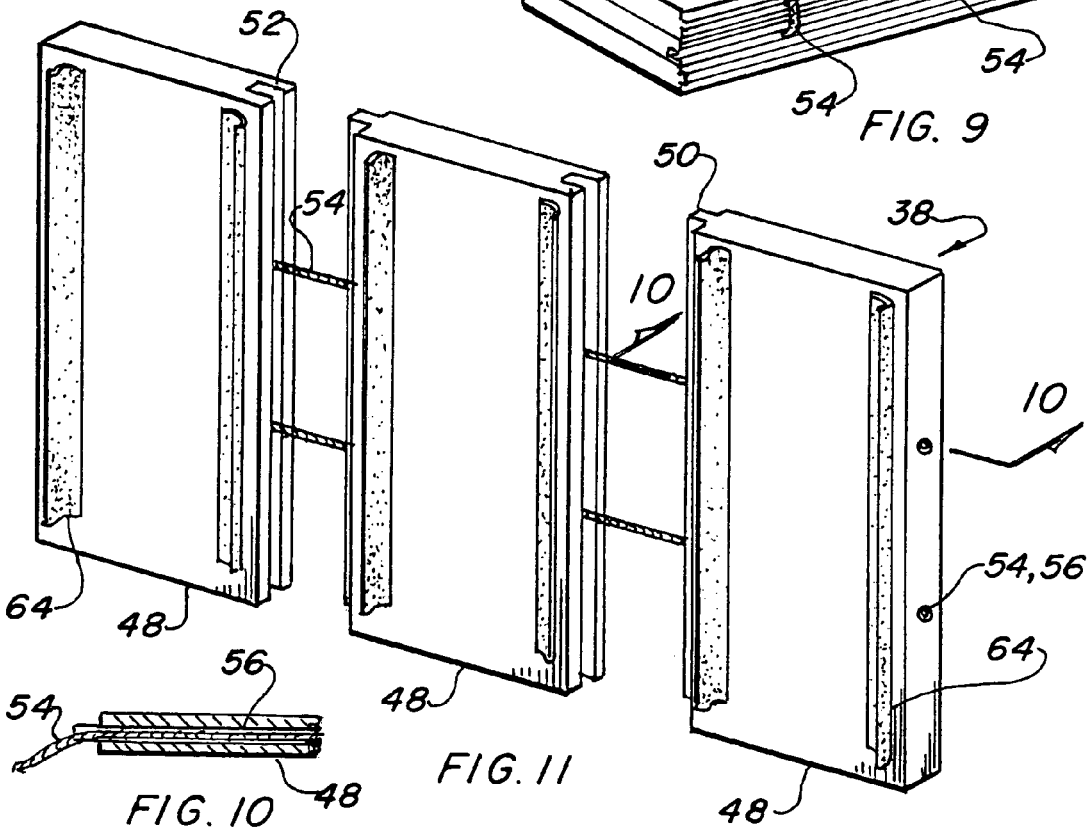
FIG. 10
FIG. 11

INTERCONNECTING SOUND ATTENUATING ENCLOSURE

TECHNICAL FIELD

The invention pertains to sound suppressing enclosures, and more specifically to a portable, interconnecting sound attenuating enclosure that is readily detachable and interconnected for ease of erection.

BACKGROUND ART

Previously, many types of modular units have been used to provide an effective means for erecting a structure usually in the building industry.

A search of the prior art did not disclose any patents that possess the novelty of the instant invention, however the following U.S. patents are considered related:

| U.S. Pat. No. | Inventor | Issue Date |
|---|---|---|
| 4,094,114 | Burcham | Jun. 13, 1978 |
| 4,545,168 | Dalton, Jr. | Oct. 8, 1985 |
| 5,528,871 | Brodeur | Jun. 25, 1996 |
| 6,421,972 | Dalphond et al. | Jul. 23, 2002 |

Burcham in U.S. Pat. No. 4,094,114 teaches a support structure for non-progressive modular wall systems. The system includes a panel retaining clip and channel-shaped stud formed for engagement. The clip is made of steel and has fingers which are pressed over a flange on a structural stud.

U.S. Pat. No. 4,545,168 issued to Dalton, Jr. is for modular wall panels that are interconnected by pairs with upper and lower side connections and are aligned to form a wall. The wall panels have a vertically arranged bracket for receiving other brackets, shelves or furnishings at desired locations.

Brodeur in U.S. Pat. No. 5,528,871 discloses a construction kit for modular floor units having an aligning member. The modular units are assembled together to form a floor with a border portion. A tongue and groove connects the floor units together, with wall units utilized to form a wall.

Dalphond et al. in U.S. Pat. No. 6,421,972 teaches a modular wall component having an insulated thermal break to prevent a thermal flow path across the component. An insulated frame is formed with track members coupled to an upper track member and a lower track member. The insulation is accomplished by means of a sheet of insulated material that is interposed into the frame structure.

For background purposes and as indicative of the art to which the invention is related, reference may be made to the remaining cited patents issued to Johnson in U.S. Pat. No. 4,189,123, U.S. Pat. No. 6,164,467 of DePottey et al. and Verdicchio in U.S. Pat. No. 6,585,028.

DISCLOSURE OF THE INVENTION

In the past, bands and other musical groups have had problems when practicing in residential locations, as well as other locations, where the sound becomes objectionable to persons in the surrounding vicinity. The inventive interconnecting sound attenuating enclosure disclosed herein, which is also known as the SOUND ASYLUM™, solves or at least minimizes the problem of the loud sound levels that are typically produced by practicing musical groups.

In its basic form, the interconnecting sound attenuating enclosure consists of:

a) a detachable structural frame that is formed of pipe with slip-in fittings, thus providing joints. The joints allow the frame to be disassembled for transportation or storage, and b) a plurality of interlocking panels covering the structural frame such that sound produced within the enclosure is attenuated to a sufficient degree to be acceptable by others nearby.

In view of the above disclosure, the primary object of the invention is to provide an enclosure that attenuates the sound created by the musical instruments, thus permitting musicians to practice in almost any location without disturbing other persons nearby.

An important object of the invention is that the enclosure is easily stored and transported from one location to another as it is light in weight and sufficiently robust to withstand frequent assembly and disassembly. Storage bags may be included that hold the enclosure's components easily, and the components are each identified for ease of assembly.

Another object of the invention is an optional window and fan that are placed into openings provided on the rear wall and on the enclosure. The window allows ambient light to enter the enclosure, and if the fan is used air circulation is provided. Further, lights may be added to other areas of the enclosure to achieve illumination within the enclosure.

Still another object of the invention is that electrical power to operate the fan and lights may be incorporated within the panels that make up the walls and top of the enclosure. The wiring is installed between the bag and the sound deadening panel in the form of flexible cords, with a connector on one end and a plug on the other in such a manner that connection may easily be accomplished.

Yet another object of the invention is that the components making up the enclosure are commonly available and relatively inexpensive, therefore the entire enclosure is well within the reach of musicians requiring such an enclosure.

These and other objects and advantages of the present invention will become apparent from the subsequent detailed description of the preferred embodiment and the appended claims taken in conjunction with the accompanying drawings.

BRIEF DESCRIPTION OF THE DRAWINGS

FIG. 7 is a cross sectional view taken along lines 7—7 of FIG. 8.

FIG. 8 is a partial isometric view of the left wall of the preferred embodiment shown alone and in the expanded condition ready for assembling of the panels together to form the wall.

FIG. 9 is a partial isometric view of the left wall folded for transportation and storage.

FIG. 10 is a cross sectional view taken along lines 10—10 of FIG. 11.

FIG. 11 is a partial isometric view of the right wall of the preferred embodiment shown alone and in the expanded condition ready for assembling of the panels to form the wall.

BEST MODE FOR CARRYING OUT THE INVENTION

Figure 5:
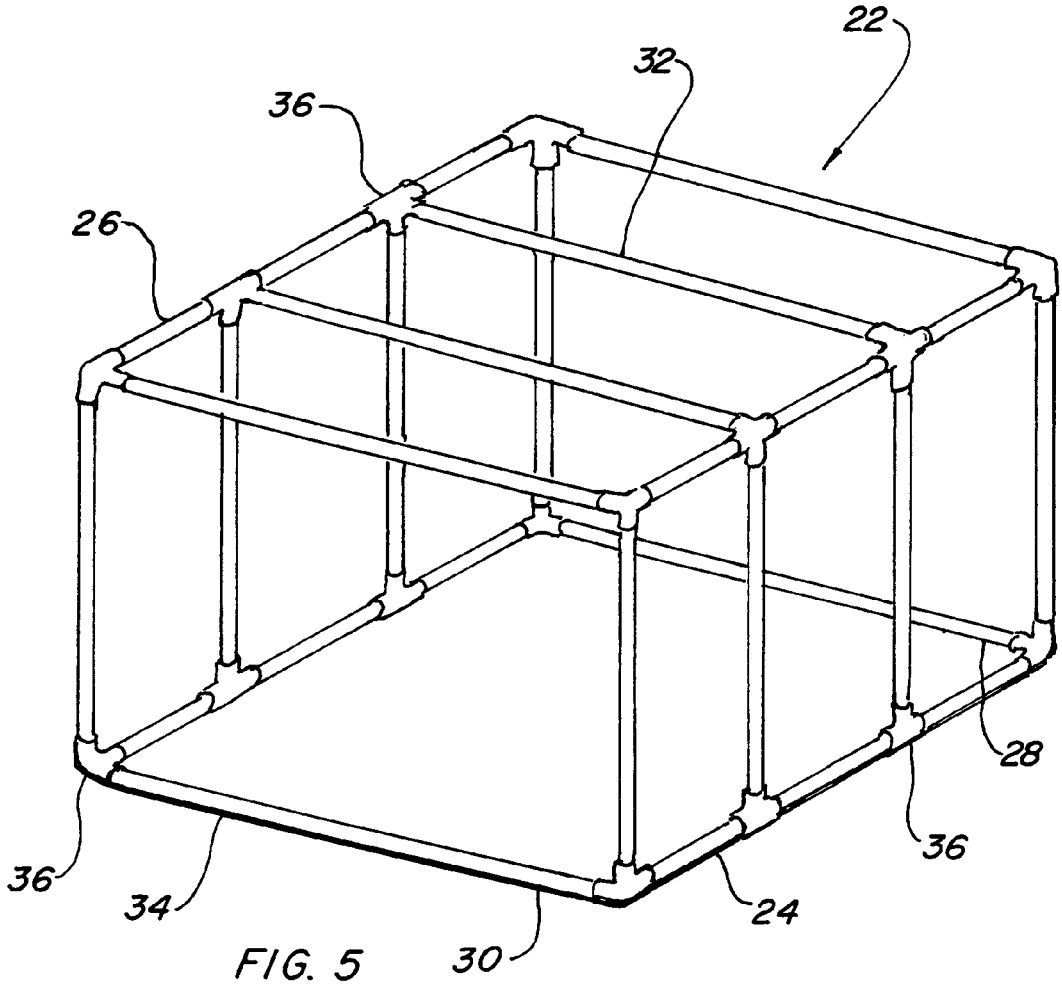
FIG. 5 is a partial isometric view of the structural frame of the preferred embodiment shown alone without a set of interconnecting pads.
Figure 6:
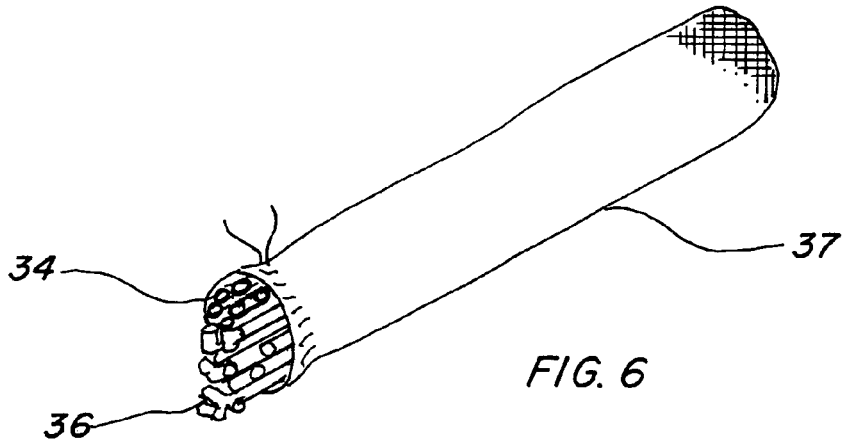
FIG. 6 is a partial isometric view of the frame components disassembled and stacked into a storage bag.
Figure 12:
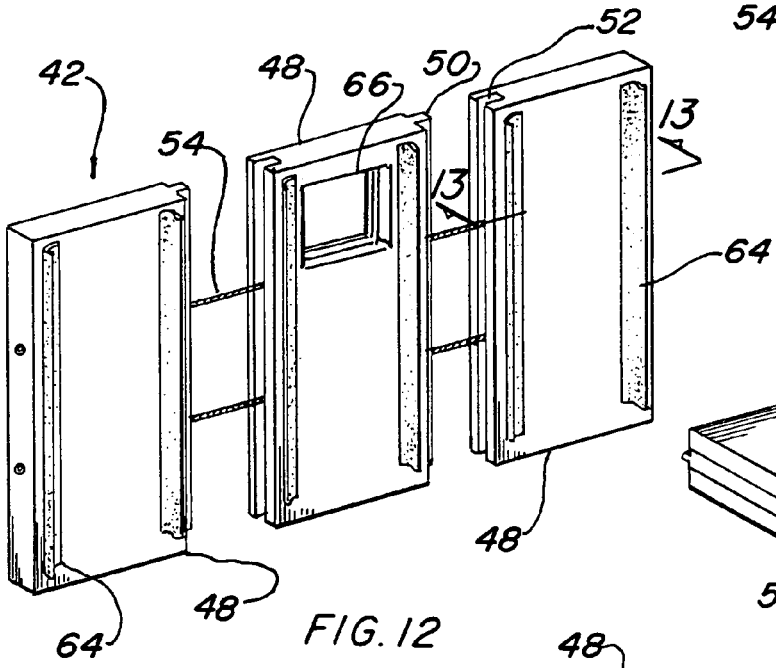
FIG. 12 is a partial isometric view of the rear wall of the preferred embodiment shown alone and in the expanded condition ready for assembling of the panels to form the rear wall.
Figure 13:
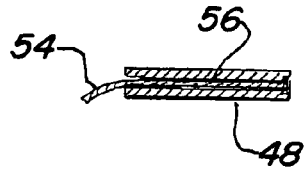
FIG. 13 is a cross sectional view taken along lines 13—13 of FIG. 12.
Figure 14:
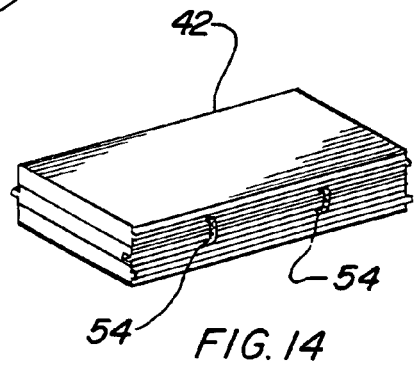
FIG. 14 is a partial isometric view of the rear wall folded for transportation and storage.
Figure 15:
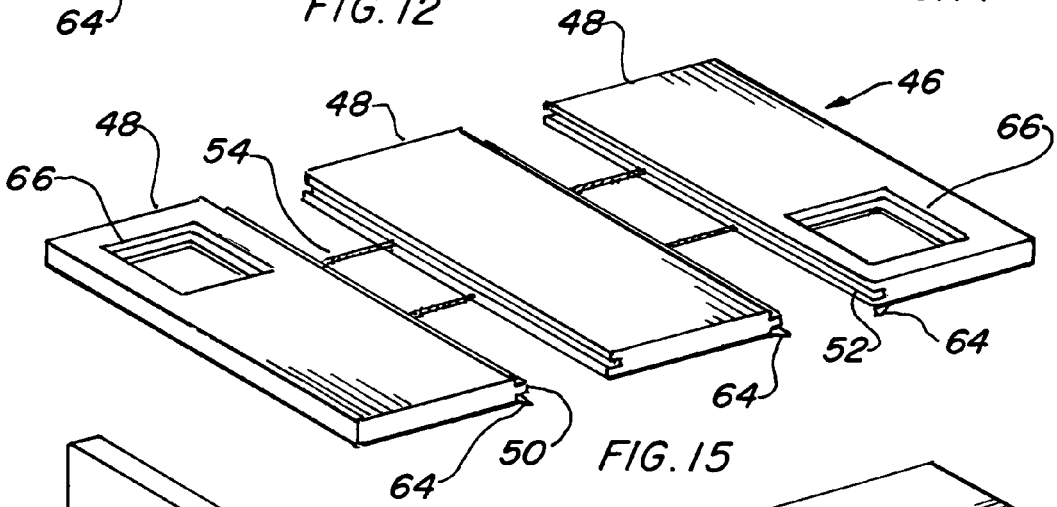
FIG. 15 is a partial isometric view of the top of the preferred embodiment shown alone and in the expanded condition ready for assembling of the panels to form the top.
Figure 16:
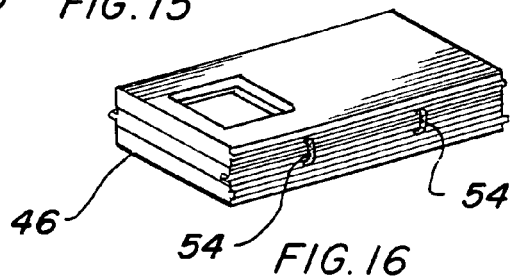
FIG. 16 is a partial isometric view of the top folded for transportation and storage.

The best mode for carrying out the invention is presented in terms of a preferred embodiment. The preferred embodiment, as shown in FIGS. 1 through 26, is comprised of an interconnecting sound attenuating enclosure 20 that consists of a structural frame 22 including a right side 24, a left side 26, a rear side 28, a front side 30 and a top section 32. The structural frame 22 is detachable and is made of thermoplastic pipe 34, which is preferably poly vinyl chloride (PVC). The frame 22 incorporates a plurality of slip-in fittings 36, thus providing removable interfacing joints that permit disassembly of the frame 22 for transportation and storage. FIG. 5 illustrates the frame 22 completely assembled with the fittings 36 at interconnecting joints. The fittings 36 are cemented on only one joint with the pipe 34, with the other joints free to separate for disassembly. A storage bag 37 is provided, as shown in FIG. 6, for storing the disassembled pipes 34 and attached fittings 36.

Figure 17:
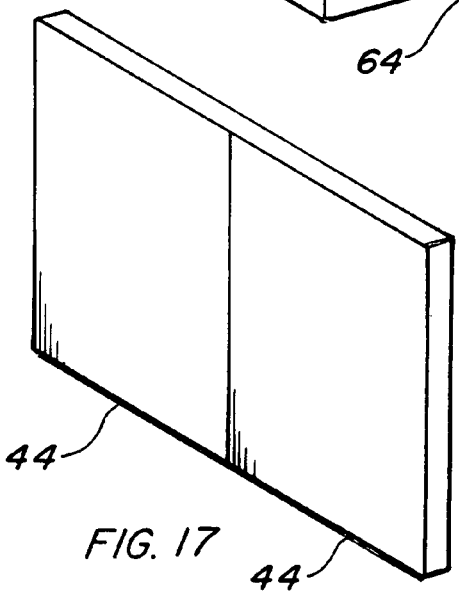
FIG. 17 is a partial isometric view of the door of the preferred embodiment shown alone ready for installation into the enclosure.
Figure 18:
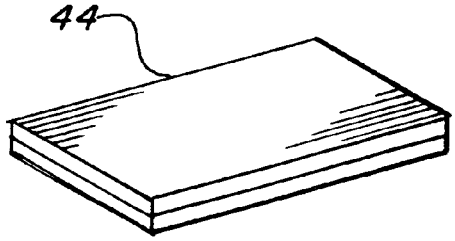
FIG. 18 is a partial isometric view of the door folded for transportation and storage.

The frame 22 is assembled and then covered on the outside with a right wall 38, illustrated in FIG. 11, that is releasably affixed to the right side 24 of the frame 22. A left wall 40, illustrated in FIG. 8, is then releasably affixed to the outside of the frame's left side 26. The next step is to add a rear wall 42, illustrated in FIG. 12, that is also releasably affixed to the outside of the frame's rear side 28. At least one door 44 is hinged to the front side 30 of the frame 22, with two doors 44 preferred, as illustrated in FIG. 17. The last step in the assembly procedure is to add a top 46, illustrated in FIG. 15, onto the frame's top section 32, completely enclosing the frame 22.

The right wall 38, left wall 40, rear wall 42 and top 46 consist of a number of panels 48, each having tongue and groove interconnections on at least one of their elongated sides. When the tongue 50 is inserted into the groove 52 a structural relationship is achieved, thereby forming the walls 38, 40 and 42 and the top 46 into a unitary section that is structurally sturdy and yet capable of being dissembled.

The panels 48 in each wall 38, 40 and 42 and top 46 are held together by elastic means in the form of elastic cords 54 that are attached on the outer edges of the walls and top through hollow conduits such as plastic tubes 56 that are placed through the panel 48 from side to side. This arrangement of cords 54 permits the panels 48 to be connected together and yet interface through the tongue 50 and groove 52 on the elongated sides. Further, this cord arrangement permits the walls 38, 40 and 42 and top 46 to be stacked on top of each other for transportation and storage, as illustrated in FIGS. 9, 14, 16 and 18.

Each panel 48 making up the walls and top is covered with a fabric bag 58 that envelopes the entire panel 48 and forms a shielded panel that is easily handled and provides external protection. The fabric bag 58 is made of a material such as woven fabric cloth, rip-stop nylon, thermoplastic film, canvas, reinforced polyethylene, vinyl coated nylon, polyurethane mesh or woven polyethylene. Each bag 58 is preferably sewn with stitching 60 and optionally may include a zipper 62 on one end for entry, or the stitching 60 may enclose the entire panel 48. It should also be noted that if thermoplastic is utilized as the covering, welding a seam is a viable alternative to sewing.

The panels 48 are fabricated of flexible polyester urethane foam, expanded polystyrene, polyvinyl foam sheet, polyurethane foam sheet, polyamide foam sheet or closed cell sheet and the like. The material for the panels 48 is rigid enough to stand alone on its end without sagging, however it may have some resilience such as encountered in padded furniture.

Figure 1:
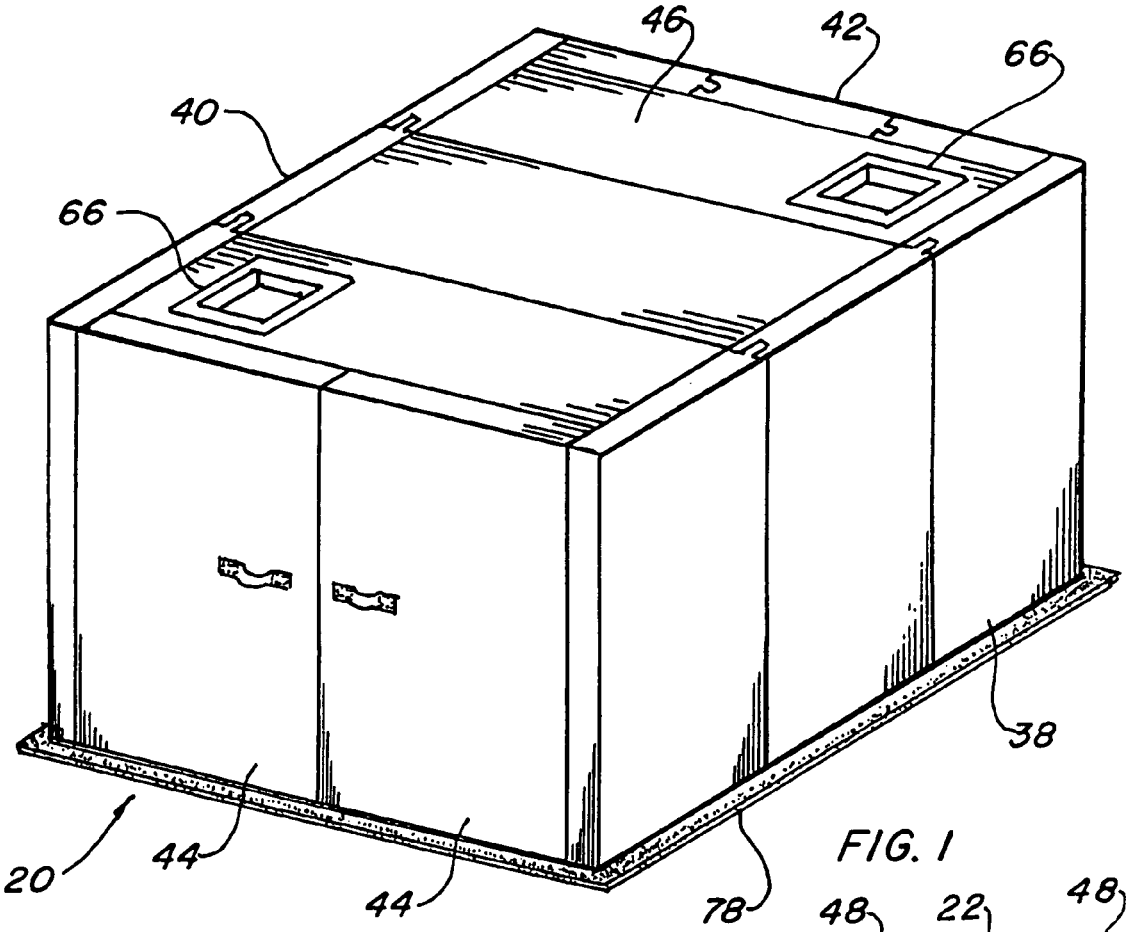
FIG. 1 is a partial isometric view of the preferred embodiment less the window or fan in the opening in the top.
Figure 2:
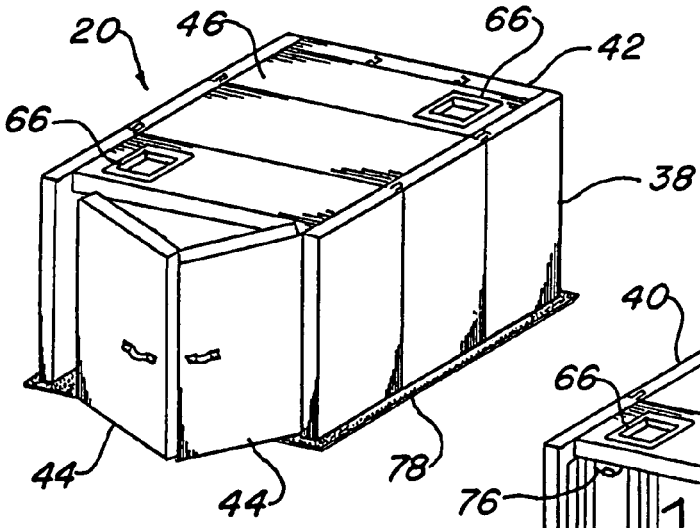
FIG. 2 is a partial isometric view of the preferred embodiment less the window or fan in the opening in the top and the front doors partially open.
Figure 3A:
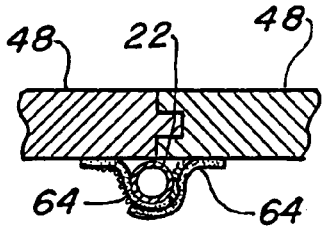
FIG. 3*a* is a cross sectional view taken along lines 3*a*—3*a* of FIG. 3.
Figure 3:
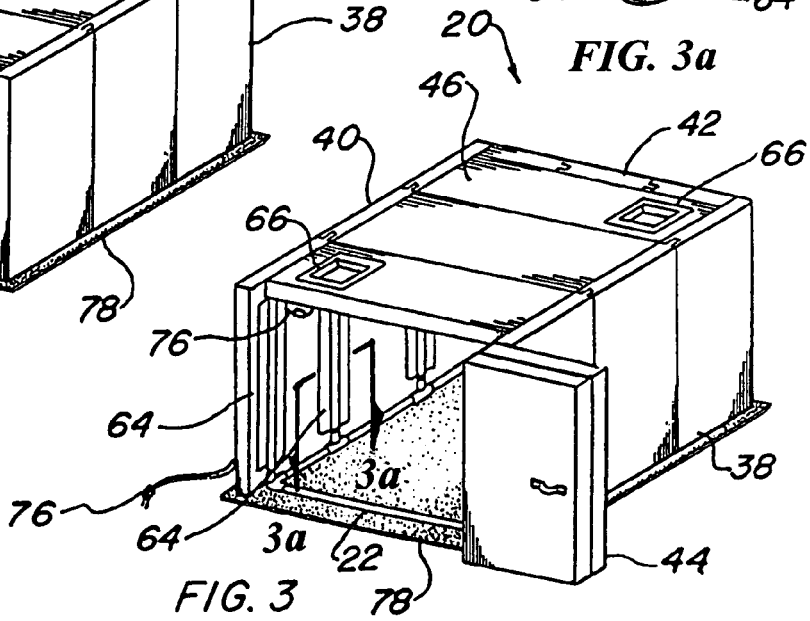
FIG. 3 is a partial isometric view of the preferred embodiment less the window or fan in the opening in the top and the front doors completely open.
Figure 4:
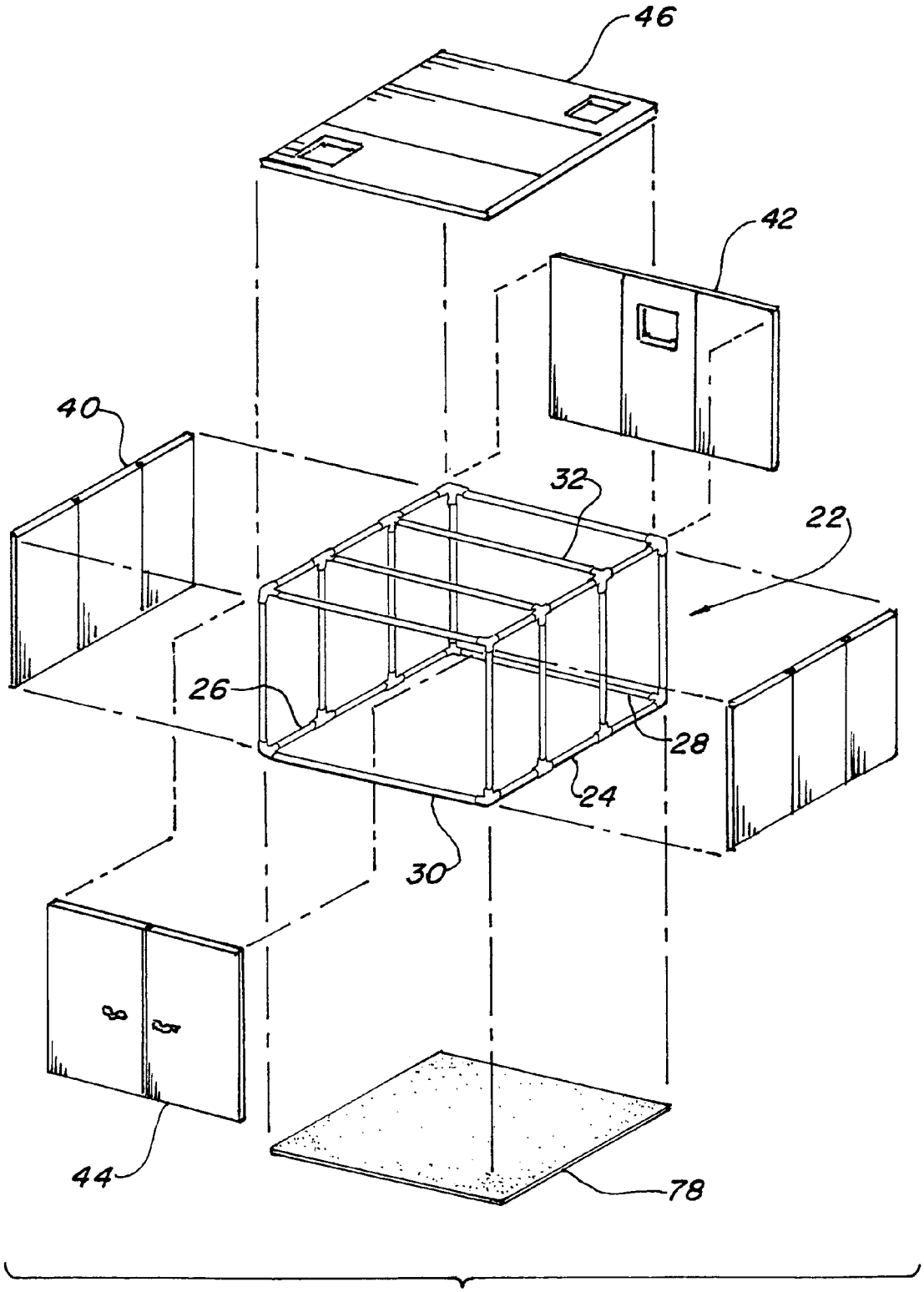
FIG. 4 is an exploded view of the invention less windows and fans.

At least one hook and loop fastener 64 is attached to each panel 48 on one or both sides for attachment to the frame 22. The attachment is accomplished by overlapping the fastener 64 from adjacent panels 48 around the frame 22, as illustrated in FIG. 3, in both the walls 38, 40 and 42 and top 46. The fastener 64 is commonly known by its trade name VELCRO.

Figure 19:
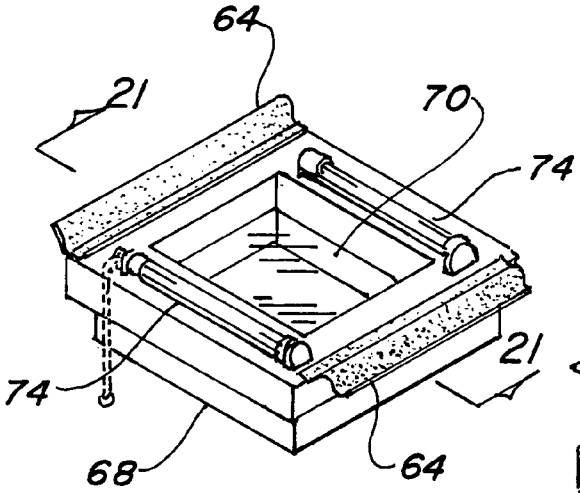
FIG. 19 is a partial isometric view of the underside of the window including lights and a pull chain switch.
Figure 20:
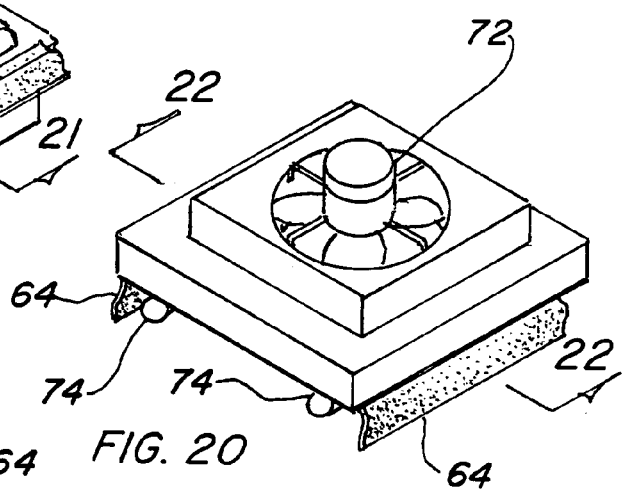
FIG. 20 is a partial isometric upper view of the fan that fits into the opening in the top of the enclosure.
Figure 21:
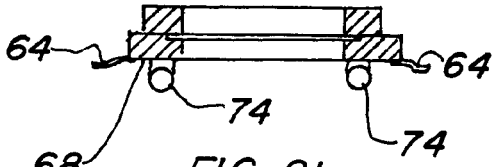
FIG. 21 is a cross sectional view taken along lines 21—21 of FIG. 19.
Figure 22:
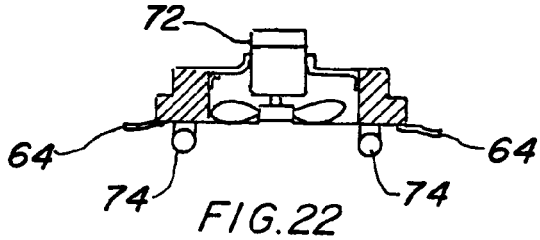
FIG. 22 is a cross sectional view taken along lines 22—22 of FIG. 20.
Figure 23:
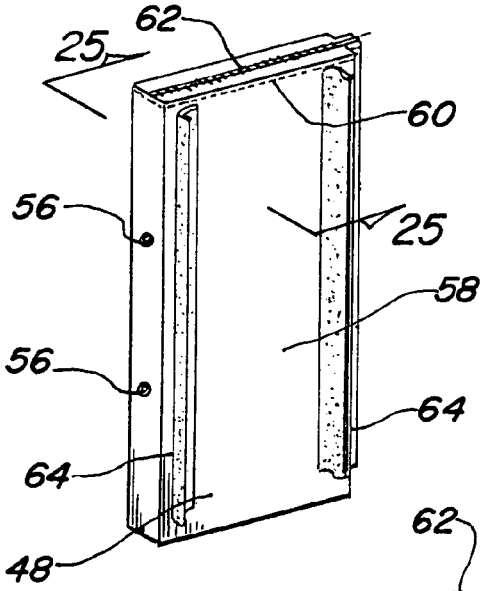
FIG. 23 is a partial isometric view of one of the panels with one tongue on the vertical side with the bag in place and the zipper on the top.
Figure 24:
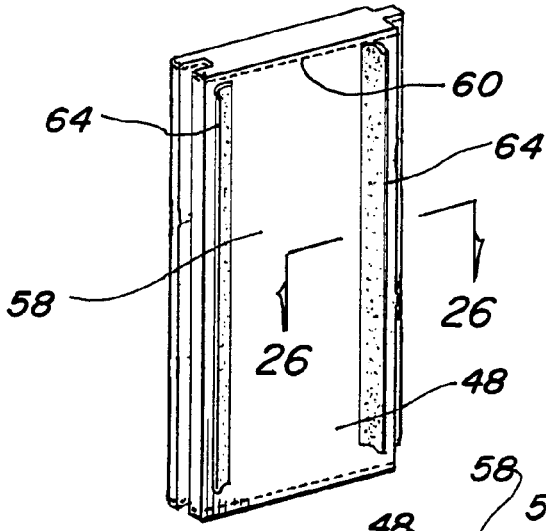
FIG. 24 is a partial isometric view of one of the panels with a tongue on one side and a groove on the other vertical side with the bag in place.
Figure 25:
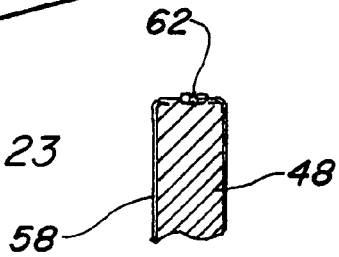
FIG. 25 is a cross sectional view taken along lines 25—25 of FIG. 23 illustrating the seams.
Figure 26:
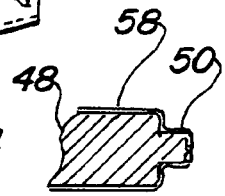
FIG. 26 is a cross sectional view taken along lines 26—26 of FIG. 24 illustrating the seam in the bag.

The rear wall 42 and top 46 have at least one opening 66 therethrough for lighting and ventilation. A window 68 may be placed in the opening 66 that includes a transparent pane 70 for admitting ambient light into the enclosure, as illustrated in FIG. 19. Optionally a fan 72, shown in FIG. 20, may also be used for circulating air within the enclosure and lights 74 may be incorporated for illumination in either the window 68 or fan 72. Wiring to accommodate the fan and lights may be installed between the bag 58 and the panel 48 in the form of flexible cords 76, with a connector on one end and a plug on the other in such a manner that connection may easily be accomplished throughout the enclosure 20.

A mat 78 may be optionally laid flat under the enclosure, as shown in FIGS. 1–4, for creating a seal between the walls 38, 40 and 42, doors 44, and the underneath surface upon which the enclosure 20 is resting.

To assemble the enclosure 20, the frame 22 is removed from the storage bag 37 and the pipes 34 are inserted into the fittings 36 and connected together. The frame 22 is then covered on the outside with the right wall 38, left wall 40, and rear wall 42 and fixed in place with the overlapping hook and loop fasteners 64 around the vertical pipes 34 of the frame 22. The door 44 is hinged to the frame front 30 with the hook and loop fasteners 64 on the corner. The last step in the assembly procedure is to add a top 46 onto the frame top 32, which completely encloses the frame 22. Windows 68 or fans 72 may be added in the openings 66 as desired.

While it is extremely difficult to completely soundproof a portable and detachable enclosure, the instant invention attenuates the sound within the enclosure to a degree sufficiently adequate to be acceptable by others nearby.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. An interconnecting sound attenuating enclosure comprising:

a) a structural frame having a right side, a left side, a rear side, a front side and a top section, b) a right wall releasably affixed to the right side of the frame, c) a left wall releasably affixed to the left side of the frame, d) a rear wall releasably affixed to the rear side of said structural frame, e) at least one door hinged to the front side of said structural frame in a releasable manner, and f) a top releasably affixed to the top of the structural frame, thus completely enclosing the structural frame so that sound produced within the enclosure is attenuated to sufficient degree to be acceptable by others nearby, wherein said right wall, left wall, rear wall and said top each comprise a plurality of panels having tongue and groove interconnections such that when the tongue is inserted into the groove a structural relationship is achieved, thereby forming the walls and the top into a unitary section that is structurally sturdy and yet capable of being dissembled.

2. The interconnecting sound attenuating enclosure as recited in claim 1 wherein said panels are held together by elastic means.

3. The interconnecting sound attenuating enclosure as recited in claim 2 wherein said elastic means further comprises a plurality of elastic cords.

4. The interconnecting sound attenuating enclosure as recited in claim 1 wherein said plurality of panels further comprise a fabric bag covering the entire panel, thereby forming a shielded panel that is easily handled and provides external protection.

5. The interconnecting sound attenuating enclosure as recited in claim 4 wherein said fabric bag is made of a material selected from the group consisting of: woven fabric cloth, rip stop nylon, thermoplastic film, canvas, reinforced polyethylene, vinyl coated nylon, polyurethane mesh and woven polyethylene.

6. The interconnecting sound attenuating enclosure as recited in claim 4 wherein said fabric bags are sewn and include a zipper on one end for entry.

7. The interconnecting sound attenuating enclosure as recited in claim 1 wherein said plurality of panels are fabricated with a material selected from the group consisting of: flexible polyester urethane foam, expanded polystyrene, polyvinyl foam sheet, polyurethane foam sheet, polyamide foam sheet and closed cell sheet.

8. The interconnecting sound attenuating enclosure as recited in claim 1 further comprising at least one hook and loop fastener that is attached to each panel on at least one side for attachment to said frame by overlapping fasteners from adjacent panels around the frame.

9. The interconnecting sound attenuating enclosure as recited in claim 1 wherein said rear wall and said top further comprise at least one opening therethrough for lighting and ventilation.

10. The interconnecting sound attenuating enclosure as recited in claim 9 wherein said opening further having a window disposed therein including a transparent pane for admitting ambient light into the enclosure.

11. The interconnecting sound attenuating enclosure as recited in claim 9 wherein said opening further having a fan disposed therein for circulating air within the enclosure.

12. The interconnecting sound attenuating enclosure as recited in claim 9 wherein said opening further having a light disposed therein for illuminating the enclosure's interior.

13. The interconnecting sound attenuating enclosure as recited in claim 1 further comprising a mat that is laid flat under said enclosure for creating a seal between the walls, door and an underneath surface upon which the enclosure is resting.

* * * * *